US005626246A

United States Patent [19]

Roddy et al.

[11] Patent Number: 5,626,246

[45] Date of Patent: May 6, 1997

[54] MODULAR DISPLAY RACK

[75] Inventors: Kim D. Roddy, Collegedale, Tenn.; Kenneth Glasener, Glenview, Ill.

[73] Assignee: McKee Foods Corporation, Collegedale, Tenn.

[21] Appl. No.: 421,488

[22] Filed: Apr. 13, 1995

[51] Int. Cl.[6] ..... A47B 57/00

[52] U.S. Cl. ..... 211/186; 211/187; 211/188; 211/193; 108/64; 108/91

[58] Field of Search ..... 108/91, 93, 92, 108/64, 65; 211/144, 188, 187, 193, 186

[56] References Cited

U.S. PATENT DOCUMENTS

| | | | |
|---|---|---|---|
| 1,109,561 | 9/1914 | Williamson . | |
| 1,992,435 | 2/1935 | Labadie et al. . | |
| 4,011,954 | 3/1977 | Galli | 211/188 X |
| 4,083,456 | 4/1978 | Genn et al. . | |
| 4,278,174 | 7/1981 | LeBlanc . | |
| 4,304,354 | 12/1981 | Shermer . | |
| 4,371,085 | 2/1983 | Fredrickson | 211/186 X |
| 4,429,850 | 2/1984 | Weber et al. | 211/193 X |
| 4,613,047 | 9/1986 | Bushyhead et al. . | |
| 4,863,042 | 9/1989 | Rohner . | |
| 4,901,872 | 2/1990 | Lang | 108/91 X |
| 4,974,734 | 12/1990 | Merl | 108/91 X |
| 4,995,668 | 2/1991 | Zivari | 108/64 X |
| 5,272,991 | 12/1993 | Carrigan, Jr. | 211/188 X |
| 5,299,690 | 4/1994 | Mund et al. . | |
| 5,322,024 | 6/1994 | Avery et al. | 108/64 |
| 5,357,876 | 10/1994 | Kniefel et al. | 108/92 |
| 5,439,122 | 8/1995 | Ramsey | 211/187 |
| 5,445,280 | 8/1995 | Rahn | 211/186 |

*Primary Examiner*—Wynn E. Wood
*Attorney, Agent, or Firm*—Dorsey & Whitney LLP

[57] ABSTRACT

A modular display rack is formed by interconnected modular display units. Each such unit consists of a base member, a back member connected to and rising above the base member at the rear thereof, and a front member connected to and depending beneath the base member at the front thereof. The front member has flanges forming a transverse channel therein and the back member has projections thereon which slidably fit within the transverse channel to interconnect two units together, with the back member of one unit releasably coupled to the front member of another unit. Projections on the undersides of the base members can receive leg members to support the units and brackets to assemble multi-tier displays. Openings along the sides of the units receive side rails which prevent products displayed on the base members from being laterally dislodged.

14 Claims, 17 Drawing Sheets

MODULAR DISPLAY RACK

TECHNICAL FIELD

This invention relates to display racks of the type used in retail stores to display items available for retail sale to the public. More specifically, this invention relates to a modular display rack capable of being configured in a variety of different positions by means of different interconnections of individual display units.

BACKGROUND

It is known expedient to provide display racks in unconnected and unerected form, to enable them to be shipped and stored in compact packages, then quickly assembled when required for use. Racks such as these are commonly used in grocery stores and department stores, for the purpose of displaying items for retail sale to the public, and for making such items available for self-selection by prospective purchasers.

The difficulty with known forms of display racks is that they are designed to have only a single configuration. That is, once the parts of the rack are assembled, the configuration of the rack will always be the same unvarying design. However, there are many instances in which a store requires a more universal form of display rack, in which the height or the width or the depth of the rack varies, depending on the use to which it is to be put and the available space for the installation of the rack. Prior art forms of display racks were not capable of such varying types of construction and uses.

Known forms of prior art display racks are disclosed in the following United States patents:

| U.S. Pat. No. | Name |
|---|---|
| 1,109,561 | Williamson |
| 1,992,435 | Libbed et al |
| 4,083,456 | Genn et al |
| 4,278,174 | LeBlanc |
| 4,304,354 | Shermer |
| 4,613,047 | Bushyhead et al |
| 4,863,042 | Rohner |
| 5,299,690 | Mund et al |

None of the display racks disclosed in these prior art patents affords the unique and novel features of the present invention.

SUMMARY OF THE INVENTION

It is, therefore, an object of the present invention to provide a new and improved form of display rack.

Another object of the present invention is to provide a new and improved form of modular display unit.

Another object of the present invention is to provide a modular display unit which may easily be joined with other identical modular display units to form a display rack of variable configuration.

Another object of the present invention is to provide a display rack formed of a plurality of interconnected modular display units.

Another object of the present invention is to provide a plurality of novel modular display units and associated hardware which can quickly and easily be assembled, without the use of tools to form various different configurations of display racks.

Another object of the present invention is to provide a display rack which has a uniform and recognizable type of appearance, regardless of the particular manner in which it is assembled.

Another object of the present invention is to provide a display rack which is easily adaptable to multiple configurations, to enable the rack to be installed in spaces of varying size and shape.

Another object of the present invention is to provide a display rack which can be installed in a free-standing position or can be installed on countertops or which can function as a standalone unit.

Other objects, advantages and salient features of the present invention will become apparent from the following detailed description, which, taken in conjunction with the annexed drawings, discloses a preferred embodiment thereof.

DESCRIPTION OF THE DRAWINGS

Referring now to the drawings, which form a part of this original disclosure.

DESCRIPTION OF THE PREFERRED EMBODIMENT

Figure 1:
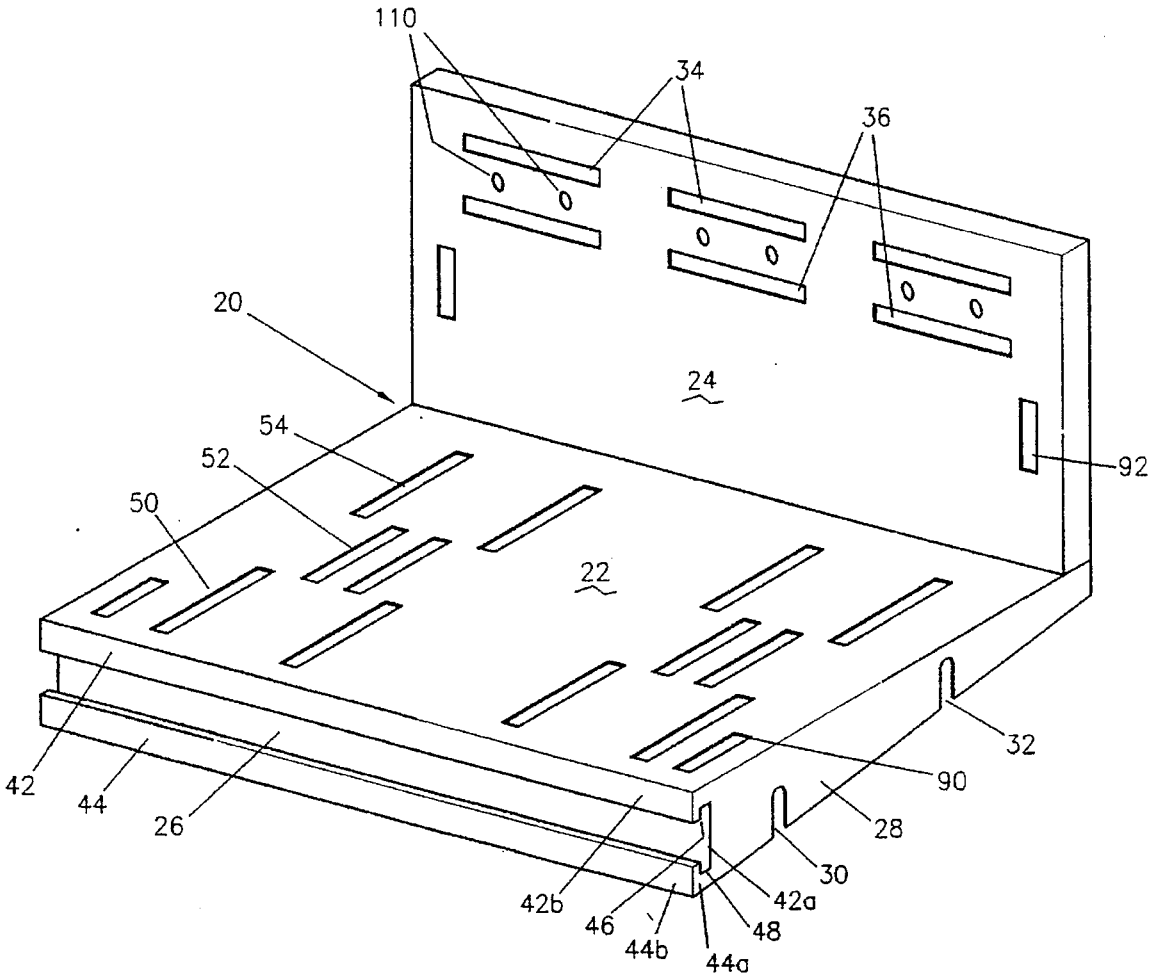
FIG. 1 is a perspective view of a modular display unit in accordance with the principles of the present invention.
Figure 2:
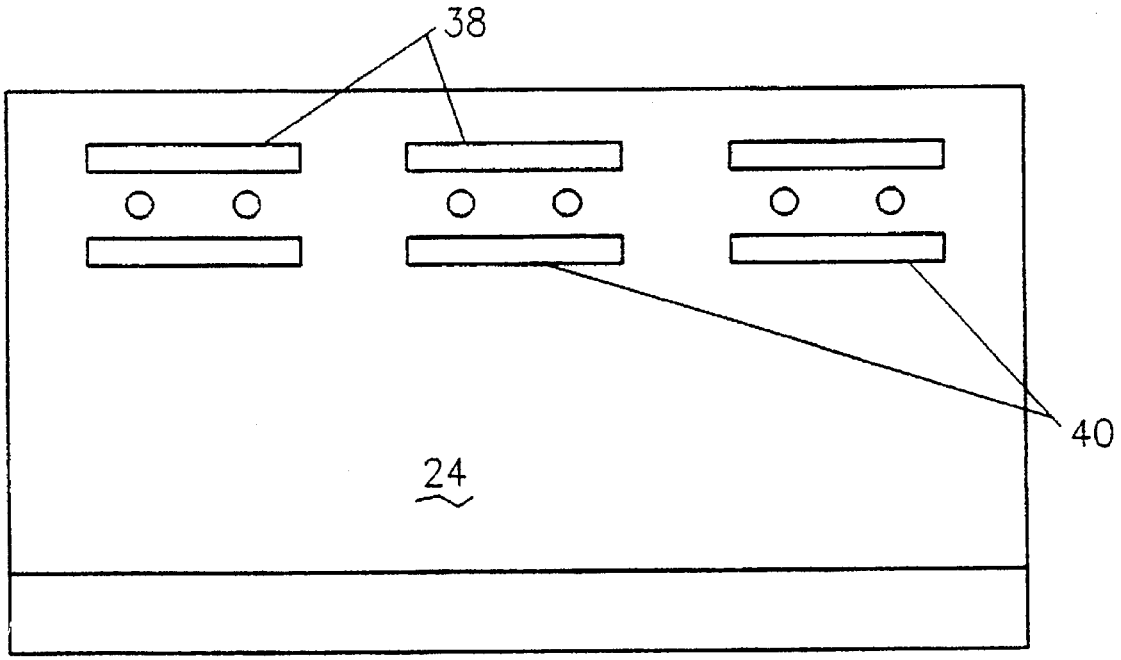
FIG. 2 is a rear elevational view of the modular display unit of FIG. 1.

Referring now to the drawings, FIG. 1 shows a modular display unit generally designated 20 in accordance with the principles of the present invention. Advantageously, the entire display unit 20 is fabricated of an injection molded rigid plastic material. The display unit includes a support unit formed by a base member 22 and a back member 24. The back member 24 is connected to the base member 22 at the rear edge thereof and is disposed at approximately ninety degrees to the base member.

Figure 13:
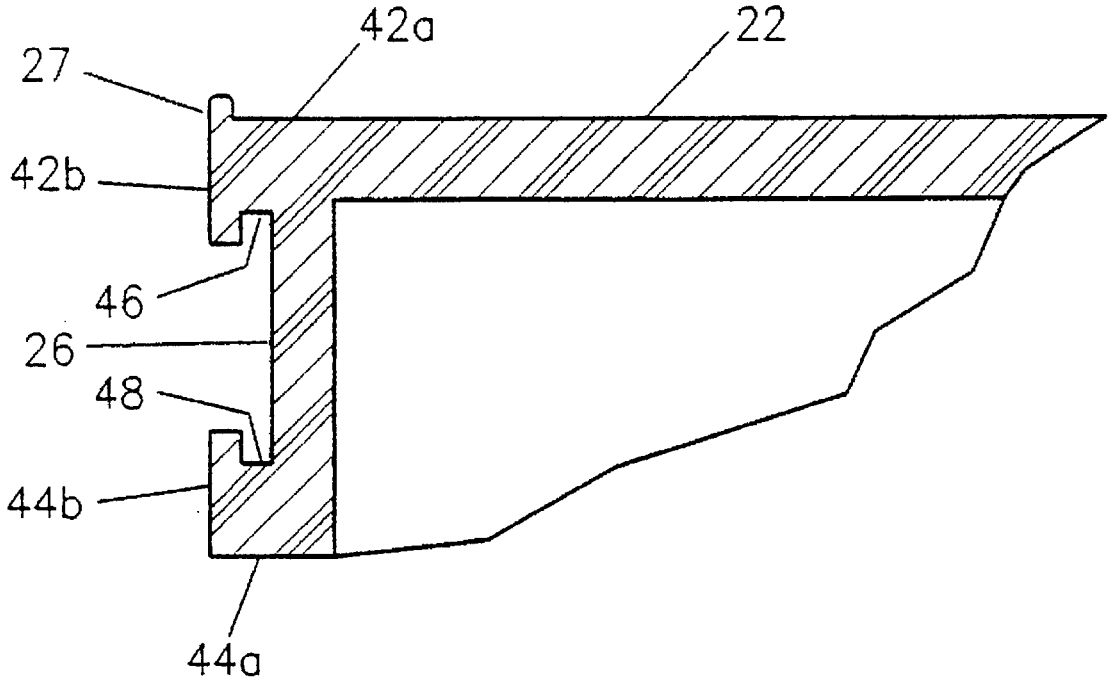
FIG. 13 is a fragmentary sectional view of the front member of the display rack.

The support unit also includes a front member 26 connected to the base member 22 at the forward edge thereof and depending therefrom at an angle of approximately ninety degrees. The front member 26 constitutes an industry standard shelf tag molding which is 1.25 inches in height. A small upraised lip 27 at the top of the front member 26 prevents items from sliding off the base member 22, as best shown in FIG. 13. The back member 24 and front member 26 are thus disposed in generally parallel relationship to each other. Side members 28 extend along opposite sides of the base member 22, from the bottom of the front member 26 to the rear of the base member 22. Forward and rear grooves 30 and 32, respectively, extend upwardly from the bottom edge of each side wall 28.

As can be seen, when the bottom edge of the front member 26 and the rear edge of the base member 22 rest on a flat supporting surface, the base member itself, and its interconnected back member 24, are inclined rearwardly by an acute angle. The amount of this angle is between 10 and 15 degrees with respect to the horizontal.

The modular display units can be interconnected, one with another, to enable a display rack to be formed by such interconnected units. In order to accomplish such interconnection, engagement means are provided on both the back member 24 and the front member 26. The engagement means on the back member is provided by a series of shoulder and flange members molded directly from the back member and thus integral therewith. As can be seen from FIG. 1, two parallel rows of openings are formed near the top of the back member. The three spaced openings in the top row are designated 34 and the three spaced openings in the bottom row are designated 36. As can be seen, the openings 36 are positioned directly beneath the openings 34. On the rear surface of the back member 24, shoulder and flange members 38 and 40 are provided, the shoulder and flange members 38 being disposed behind the openings 34 and the shoulder and flange members 40 being disposed behind the openings 36.

Figure 3:
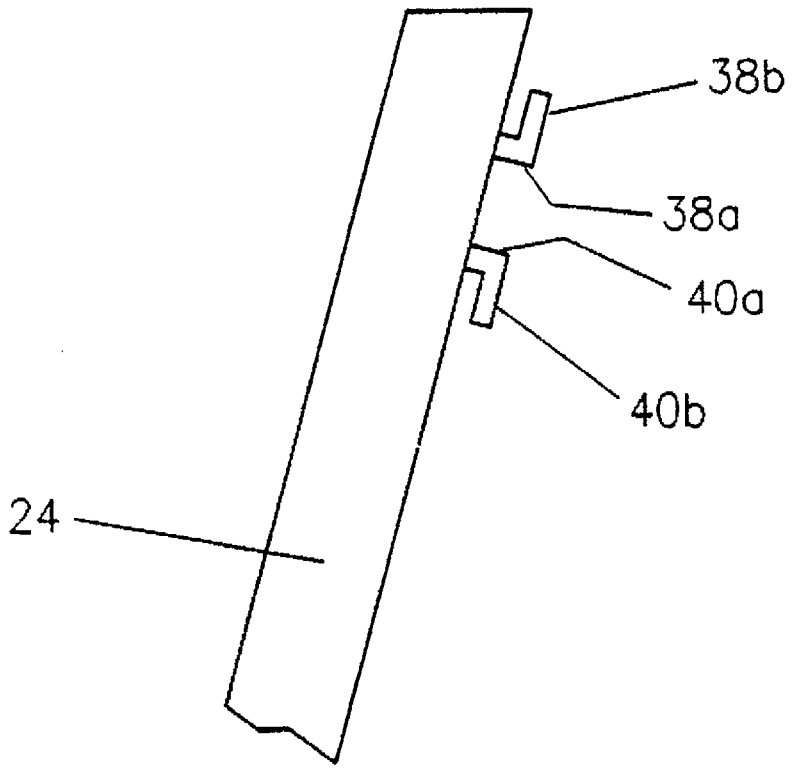
FIG. 3 is a fragmentary side elevational view of the back portion of the modular display unit of FIG. 1.

As can best be seen from FIG. 3, the shoulder and flange member 38 includes a shoulder portion **38*a* projecting perpendicularly outward from the back member 24 and an attached flange portion 38*b* extending parallel to the back member and toward the upper edge thereof. The shoulder and flange portion 40 includes a shoulder portion 40*a* extending perpendicularly outward from the back member 24 and an attached flange portion 40*b* extending parallel to the back member 24** and toward the lower edge thereof.

As shown in FIG. 13, the engagement means on the front member 26 is formed by an upper shoulder and flange portion 42 and a lower shoulder and flange portion 44. The upper shoulder and flange portion 42 includes a shoulder portion **42*a* extending coextensively with the base member 22 and beyond the front member 26 and an attached flange portion 42*b* which depends perpendicularly downward in spaced parallel relation to the front member 26. The lower shoulder and flange portion 44 includes a shoulder portion 44*a* extending perpendicularly forwardly from the bottom of the front member 26 and an attached flange portion 44*b* which projects upwardly in spaced parallel relation to the front member 26**.

As a result of this arrangement of shoulders and flanges, a pair of channels are formed adjacent the front of the front member 26. A first channel 46 is formed between the front surface of the front member 24 and the inner surface of the flange **42*b*. A second channel 48 is formed between the front surface of the front member 24 and the inner surface of the flange 44*b***.

Figure 7:
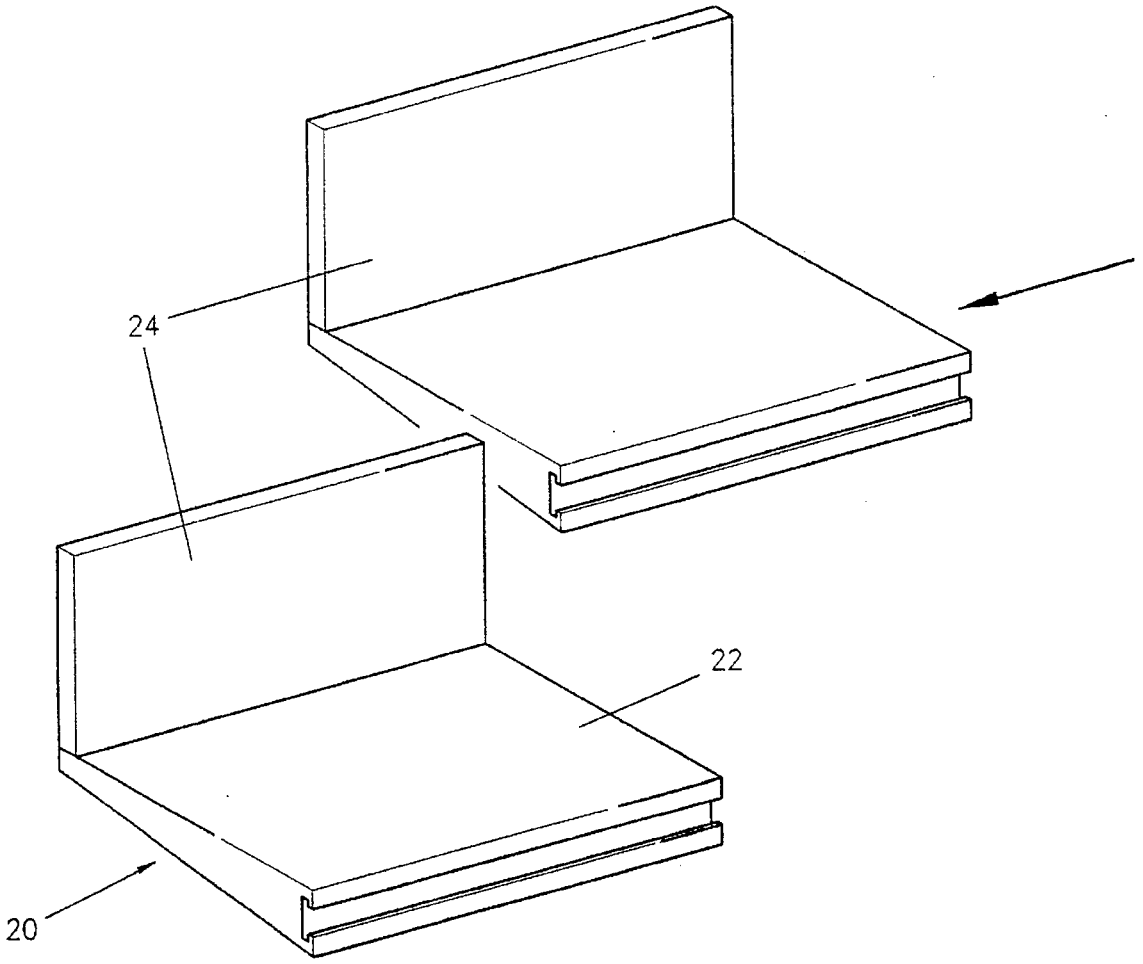
FIG. 7 is a perspective view of two modular display units being coupled together to form a display rack.

The shoulder and flange arrangements 38 and 40 on the rear surface of the back member 24 are configured to fit exactly within the channels 46 and 48 along the front member 26. As shown in FIG. 7, when one display unit 20 is positioned adjacent another such unit, with the channels 46, 48 on one unit aligned with the shoulder and flange members 38, 40 of the other unit, the two units may be releasably interconnected with one another by sliding them sidewards relative to each other. In doing so, the upper flange portions **38*b* along the back on one unit will fit exactly within the upper channel 46 along the front of the other unit and the lower flange portions 40*b* along the back of one unit will fit exactly within the lower channel 48** along the front of the other unit.

Openings are also formed within the base member to align above flange and shoulder arrangements positioned beneath the base member 24. As can be seen from FIG. 1, a series of six parallel openings are provided along the opposite sides of the base member 24. There are two such openings 50 along the front of each side of the base member, two such openings 54 spaced rearwardly of the front set of openings 50, and two narrower intermediate openings spaced both longitudinally and transversely between the openings 50 and 54.

Figure 4:
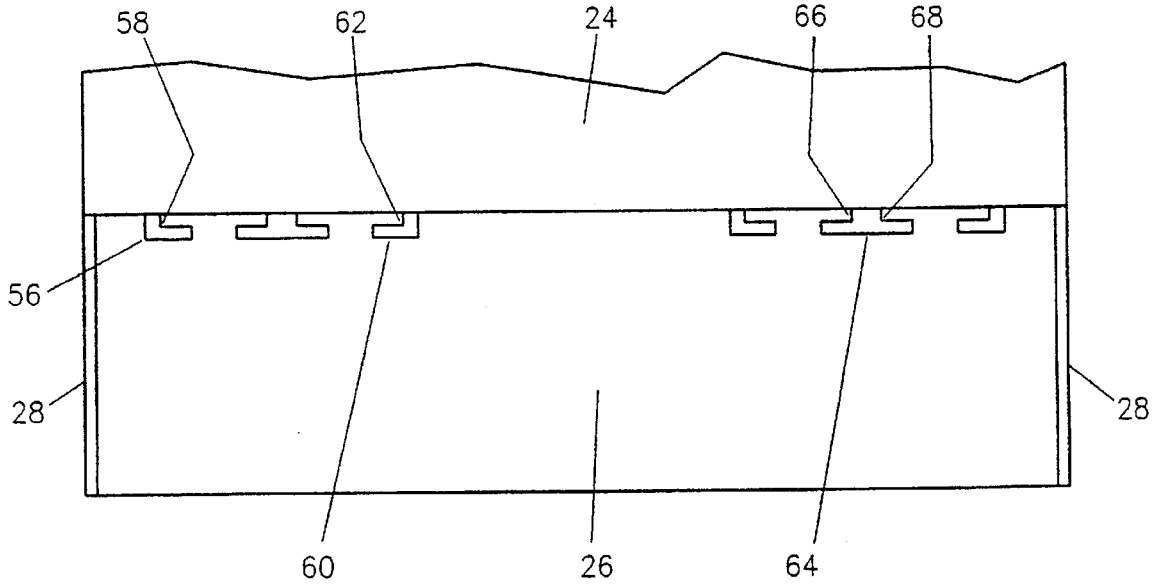
FIG. 4 is fragmentary rear elevational view of the base portion of the modular display unit of FIG. 1.

As can best be seen from FIG. 4, two outer engagement members 56 are provided beneath the base member aligned under the outer openings 50 and 54. Each outer engagement member 56 includes a shoulder portion depending from the underside of the base member and an attached flange portion projecting inwardly from the shoulder portion to form a channel 58 under the base member. Two inner engagement members 60 are aligned beneath the inner openings 50 and 54 and, just as with the member 56, each forms a channel 62 under the base member. Two intermediate engagement members 64 are provided beneath the base member aligned under the intermediate openings 52. Each intermediate engagement member includes a shoulder portion depending from the underside of the base member and attached flange portions extending laterally inwardly and outwardly, to form two channels 66 and 68 beneath the base member.

Figure 5:
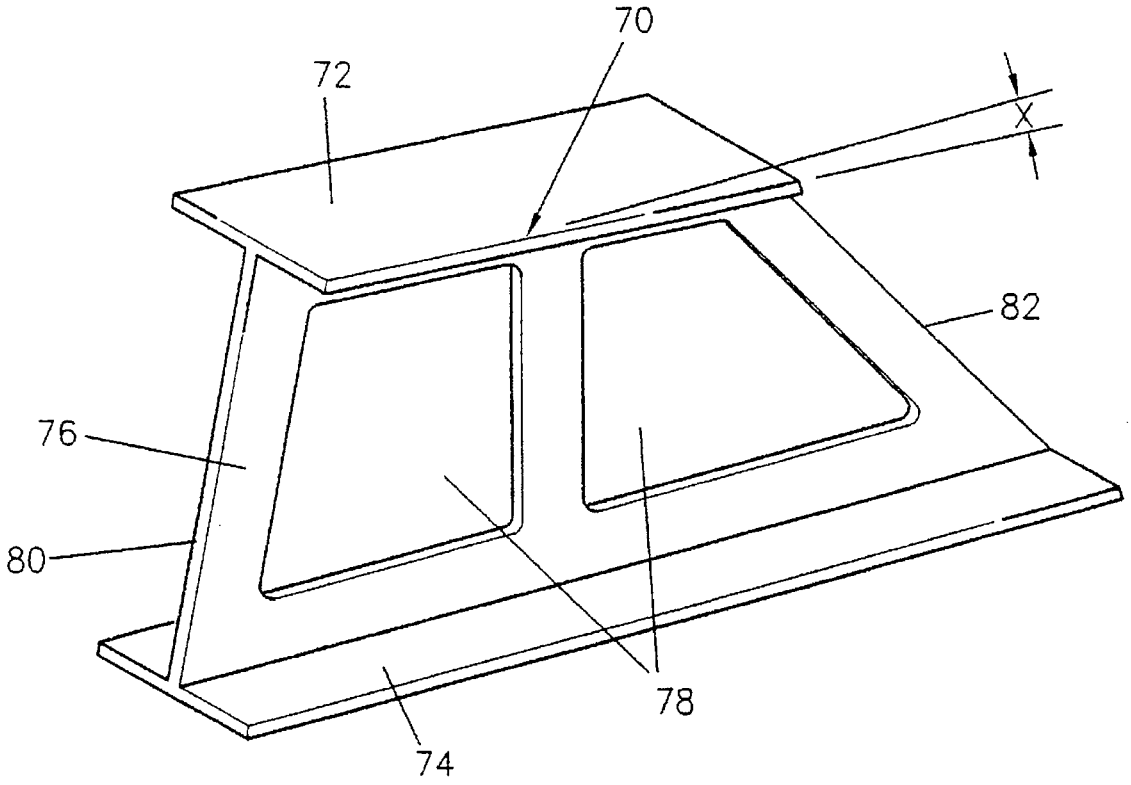
FIG. 5 is a perspective view of a support leg member for the modular display unit of FIG. 1.

Support leg members generally designated 70 are provided, as shown in FIG. 5, with each such leg member 70 having an upper portion 72 and a flat horizontal lower portion 74, joined together by an upright vertical portion 76, which can have large sections cut away to form openings 78. The openings 78 reduce the weight and the cost of the leg members 70. The forward edge 80 of the leg member 70 is angled slightly rearwardly and the rear edge 82 thereof is angled forwardly at a greater angle. The upper portion 72 is inclined with respect to the horizontal lower portion 76 by an acute angle x of 10 to 15 degrees, the same as the base member is inclined with respect to the horizontal.

Figure 8:
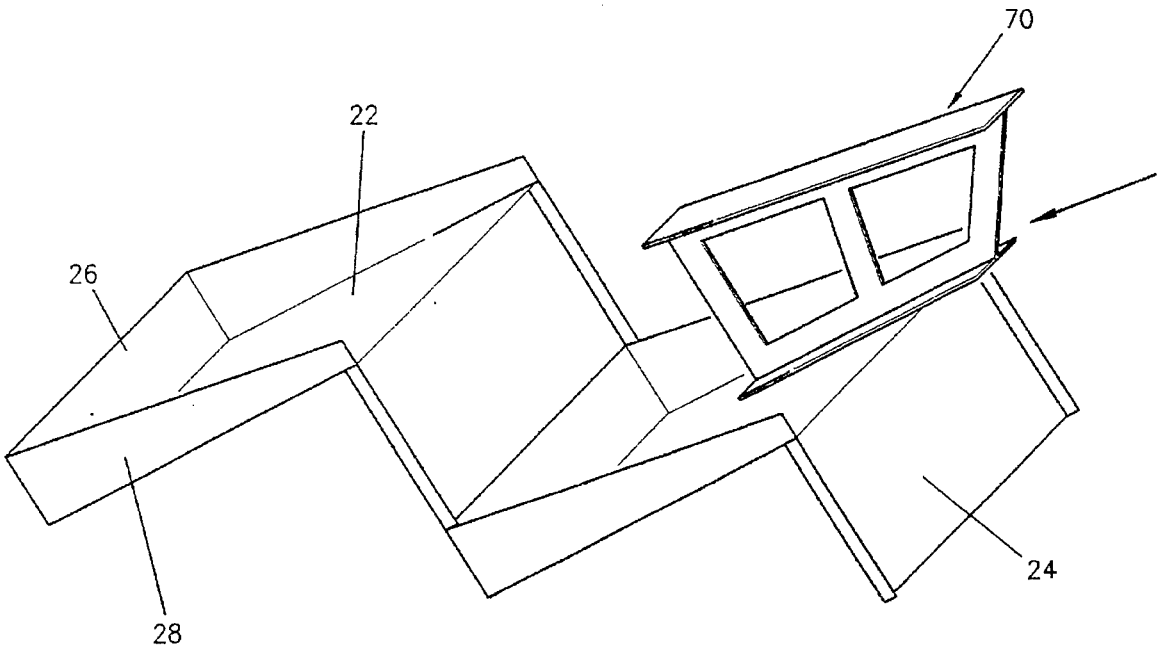
FIG. 8 is a perspective view of a support leg member being coupled to a display rack.

As shown in FIG. 8, leg members 70 are insertable into the engagement means beneath the display unit base member. The leg members fit into the inner set of engagement means. That is, the upper portion 72 of the leg member is configured to slidably fit within the channels 62 and 66. Each leg member 70 is slid forwardly until the forward edge 80 thereof abuts against the inner surface of the front member 26. When two such leg members 70 are mounted beneath a display unit, the unit is supported by resting upon the lower leg portions 74 which sit upon a supporting surface such as a shelf or the floor. Nonskid pads, not shown, may be adhesively attached to the bottom of the leg members to prevent sliding.

Figure 6:
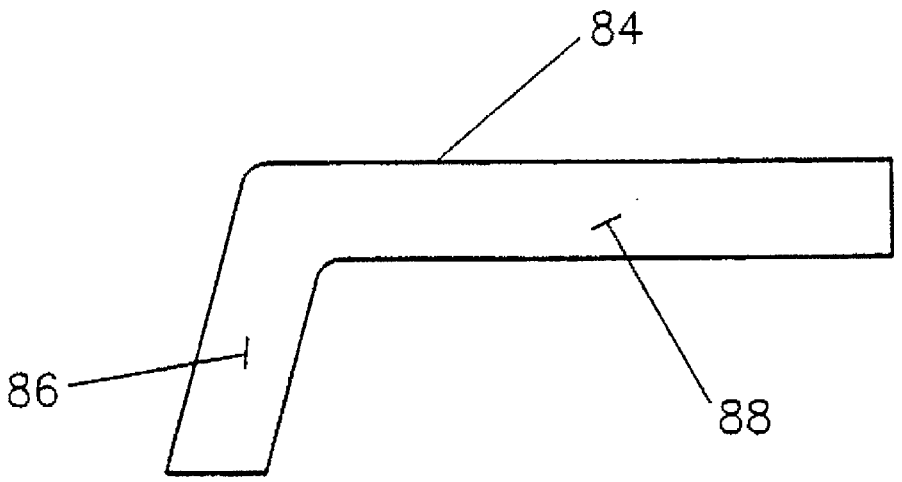
FIG. 6 is a side elevational view of an arm member for the modular display unit of FIG. 1.

In order to keep items positioned on a display unit in a display rack from becoming laterally dislodged, side rail or arm members generally designated 84 are provided, as shown in FIG. 6. Each arm member is generally L-shaped and includes a forward generally vertical portion 86 and a rearward generally horizontal portion 88. As can be seen from FIG. 1, a pair of slots 90 are formed along the outer edges at each side of the base member 22. Another pair of slots 92 are formed along the outer edges at each side of the back member 22. The arms 84 snap into these slots, with the ends of the forward arm portions 86 fitting into the slots 90 and the ends of the rearward arm portions 88 fitting into the slots 92.

Figure 9:
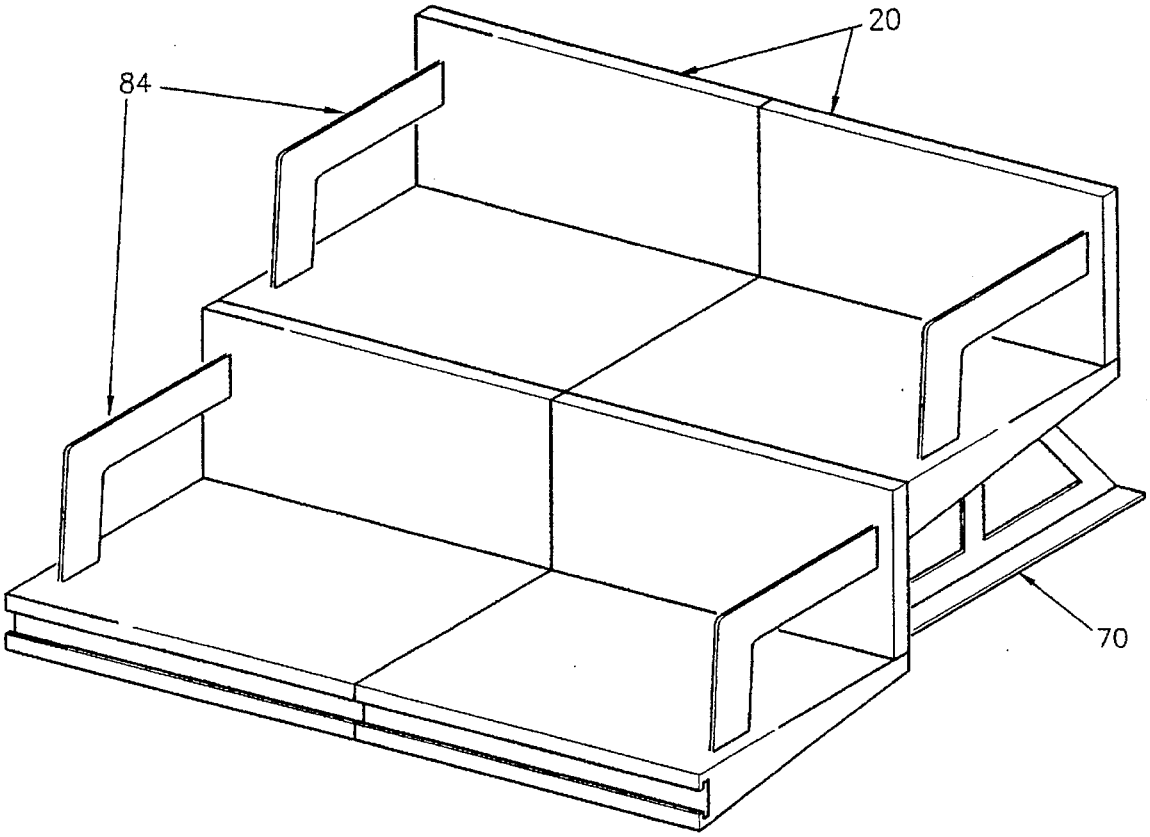
FIG. 9 is a perspective view of a display rack created by interconnected modular display units.

FIG. 9 shows a display rack formed by four interconnected modular display units 20. As can be seen, arm members 84 are provided along the outer sides of the display rack and leg members 70 serve to support the assembled rack. The rack also rests on the lower edge of the front members of the lowermost display units and along the lower edge of the sides 28 of the lowermost display unit.

Figure 14:
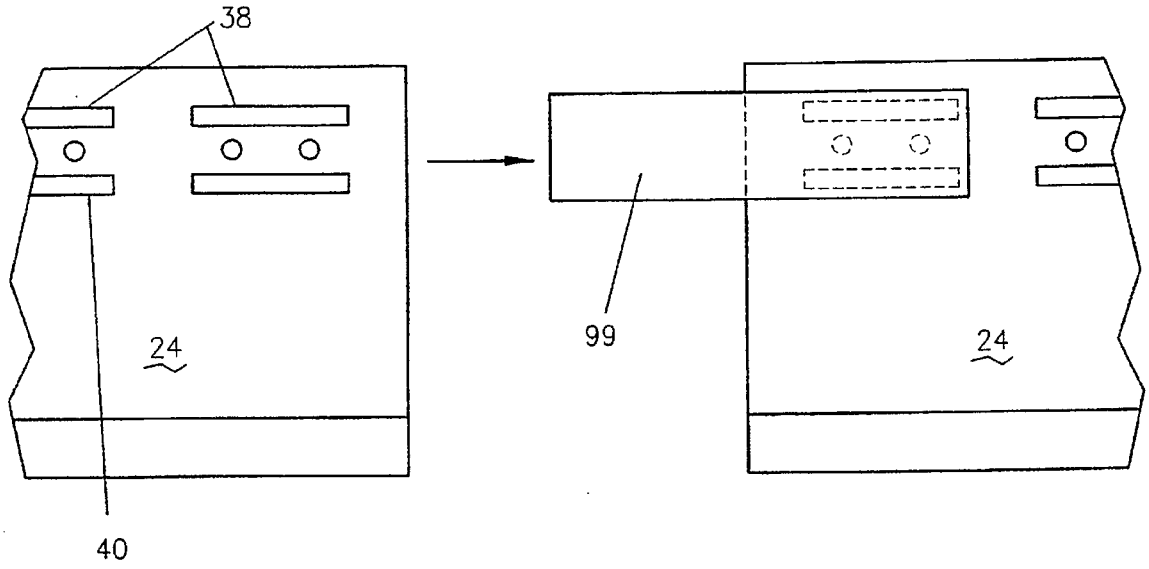
FIG. 14 is a rear elevational view showing how two adjacent display rack sections can be interlocked.

When the display units are arranged to form a display rack as shown in FIG. 9, it is useful to provide means to prevent the laterally adjacent units from separating. As shown in FIG. 13, generally H-shaped connectors generally designated 94 can be used for this purpose. Each connector 94 includes a pair of spaced outer walls 96 joined by a central connecting wall 98. The connectors 94 are employed by inserting them manually into the grooves 30 and 32 along the side walls 28. When so inserted, one outer wall 96 abuts against the inside of one side wall 28, the other outer wall abuts against the inside of the juxtaposed side wall on the adjacent unit, and the central connecting wall fits into the aligned grooves 30 or 32 of the two side walls. Also, as shown in FIG. 14, a C-shaped channel member 99 is used to lock two adjacent sections together by slidably engaging the shoulder and flange arrangement 38, 40 on the rear of the back sections 24.

Figure 10:
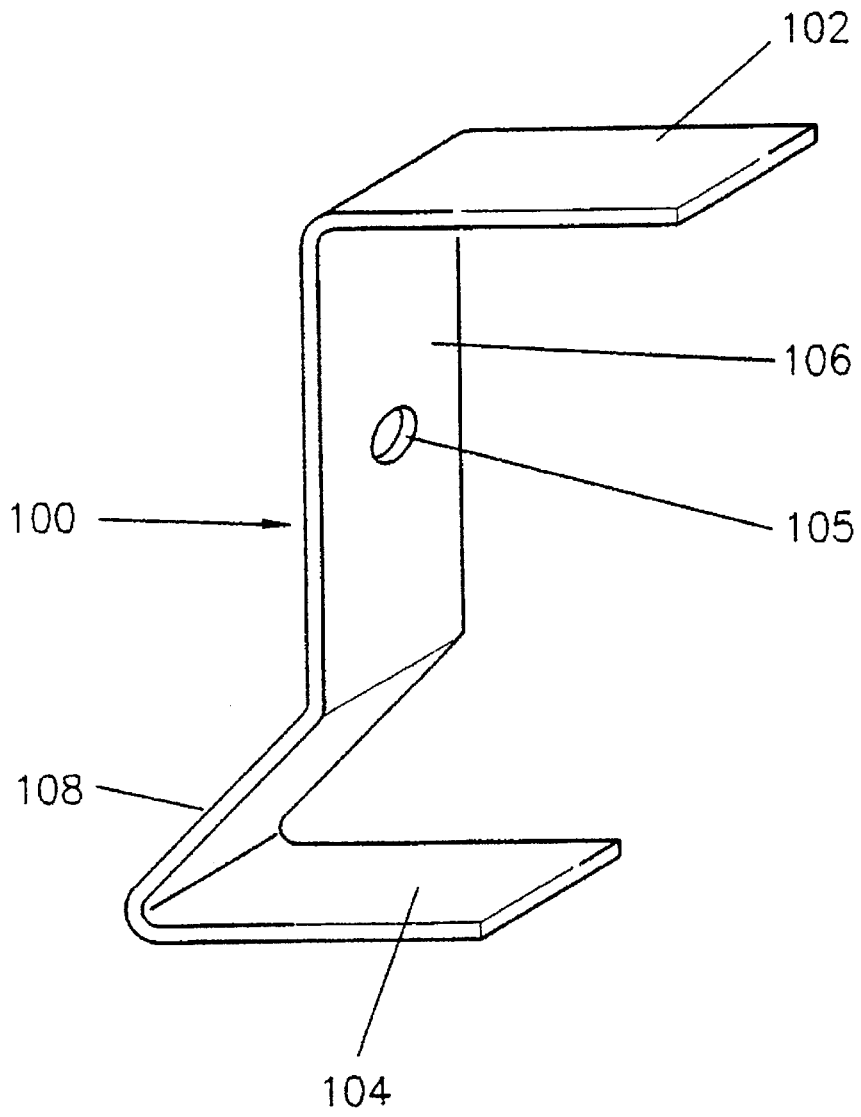
FIG. 10 is a perspective view of a modified form of support leg member.

The display rack shown in FIG. 9 is a double two deep stair arrangement. The present invention also permits a three deep stair arrangement which can be accomplished through the use of supplemental support leg members such as that shown in FIG. 10 and generally designated 100. Such leg members include parallel top sections 102 and bottom sections 104, joined by an intermediate upright leg section having a vertical portion 106 and a rearward angularly disposed portion 108. On a three deep stair display rack arrangement, two support leg members 100 would be employed. The top sections of each would slidably fit within the channels 58 and 66 on the underside of the base member of the uppermost display unit 20. The height of the leg members 100, from the bottom 104 to the top 102 thereof, is designed to be equal to the distance from the bottom of the uppermost or third display unit to the bottom or supporting surface on which the rack is positioned. Apertures 105 in the vertical portions can receive push pins to help assemble the support leg members to the display units.

Figure 11:
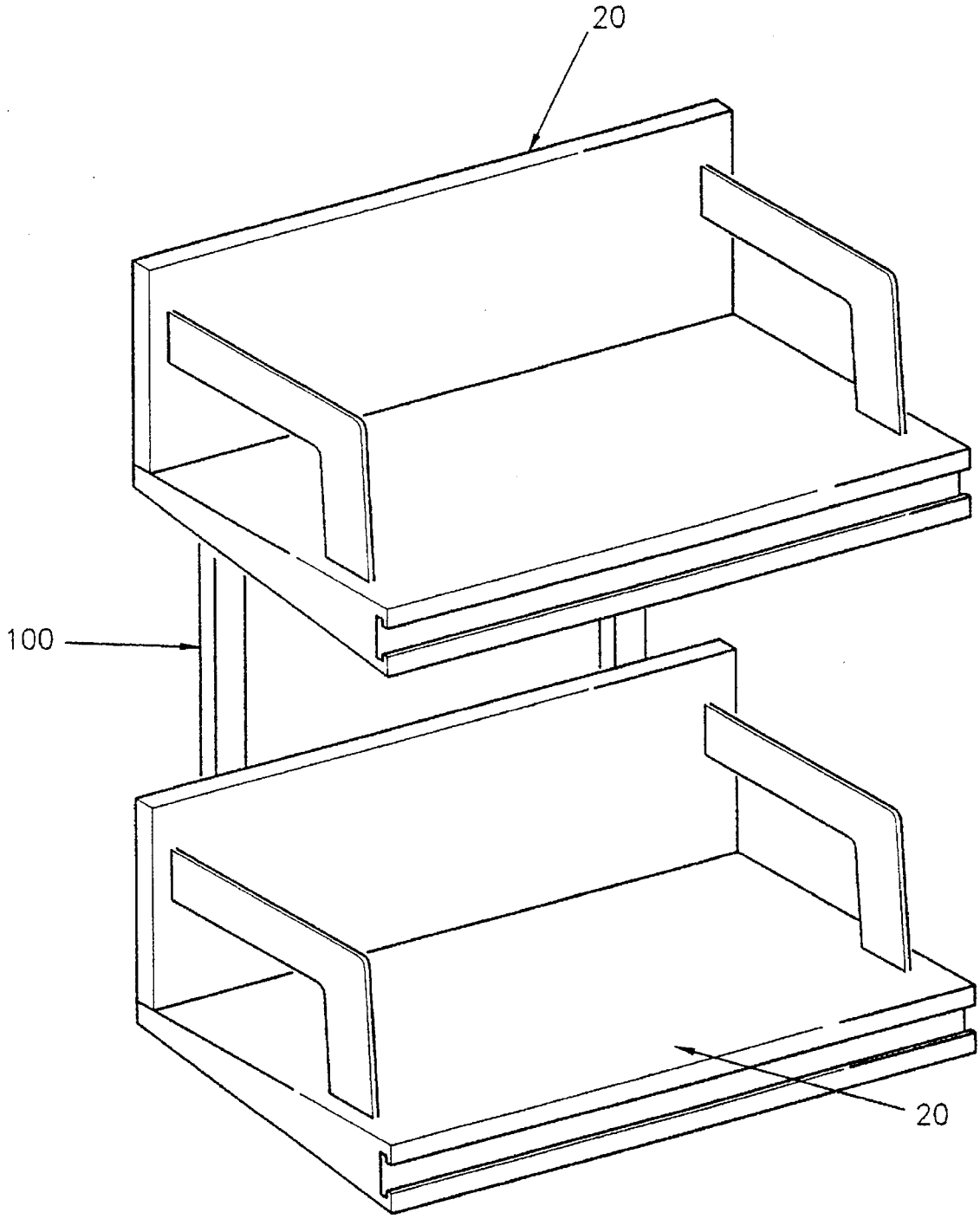
FIG. 11 is a perspective view of a modified form of display rack created by interconnected modular display units.
Figure 12:
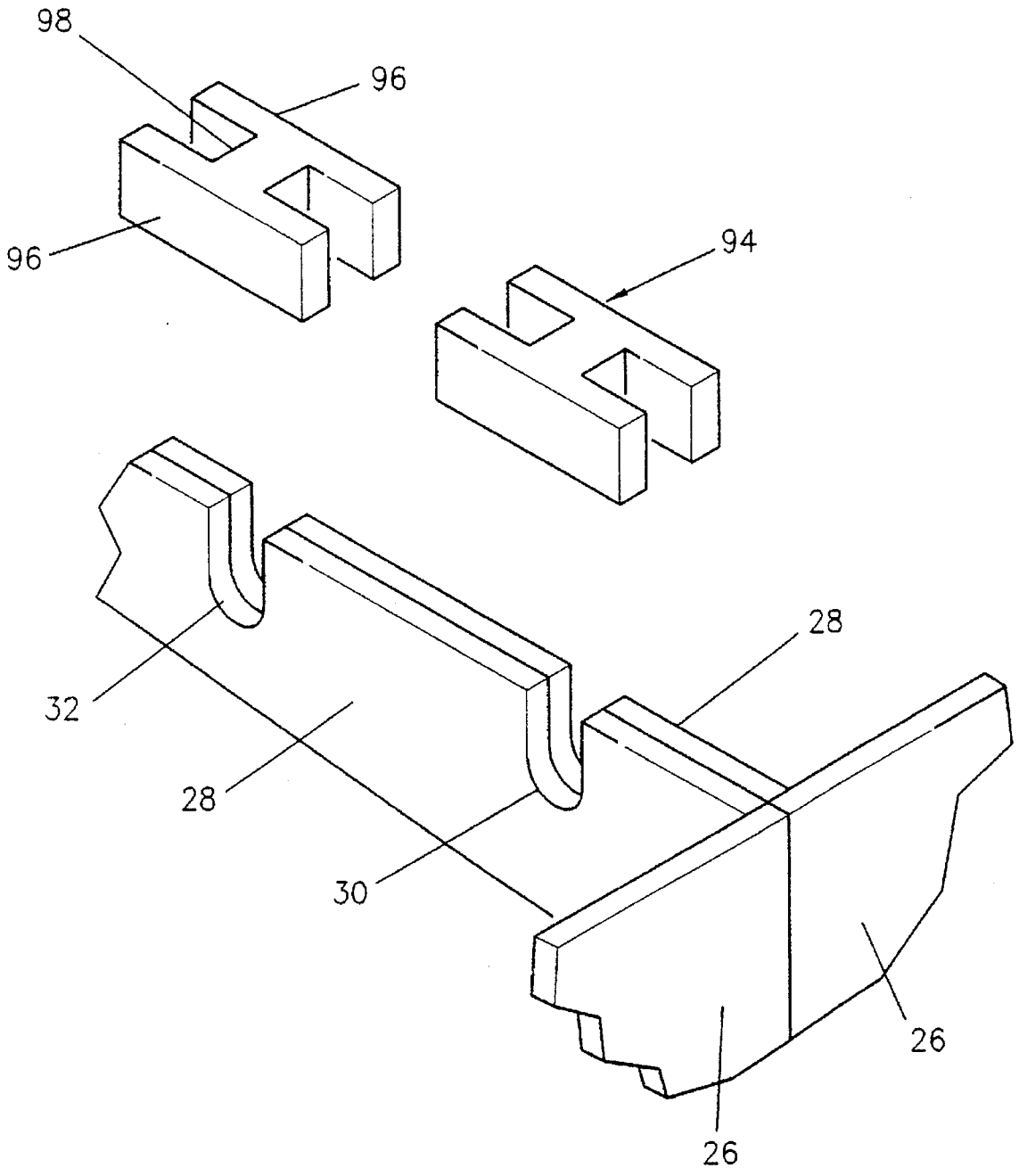
FIG. 12 is a fragmentary perspective view showing connector members which can be used to interconnected two display units arranged side by side.

In other instances, the support units of the present invention may be configured to form a tower display rack. Such a rack is shown in FIG. 11 in the form of a two-high rack. In this instance, two support units 20 are positioned one above the other, and are coupled by means of two support legs 100. The upper sections 102 of the support legs slidably engage in the channels 58 and 66 on the underside of the base member of the upper support unit 20 while the lower sections 104 of the support legs slidably engage in the channels 58 and 66 on the underside of the base member of the lower support unit 20.

Figure 16:
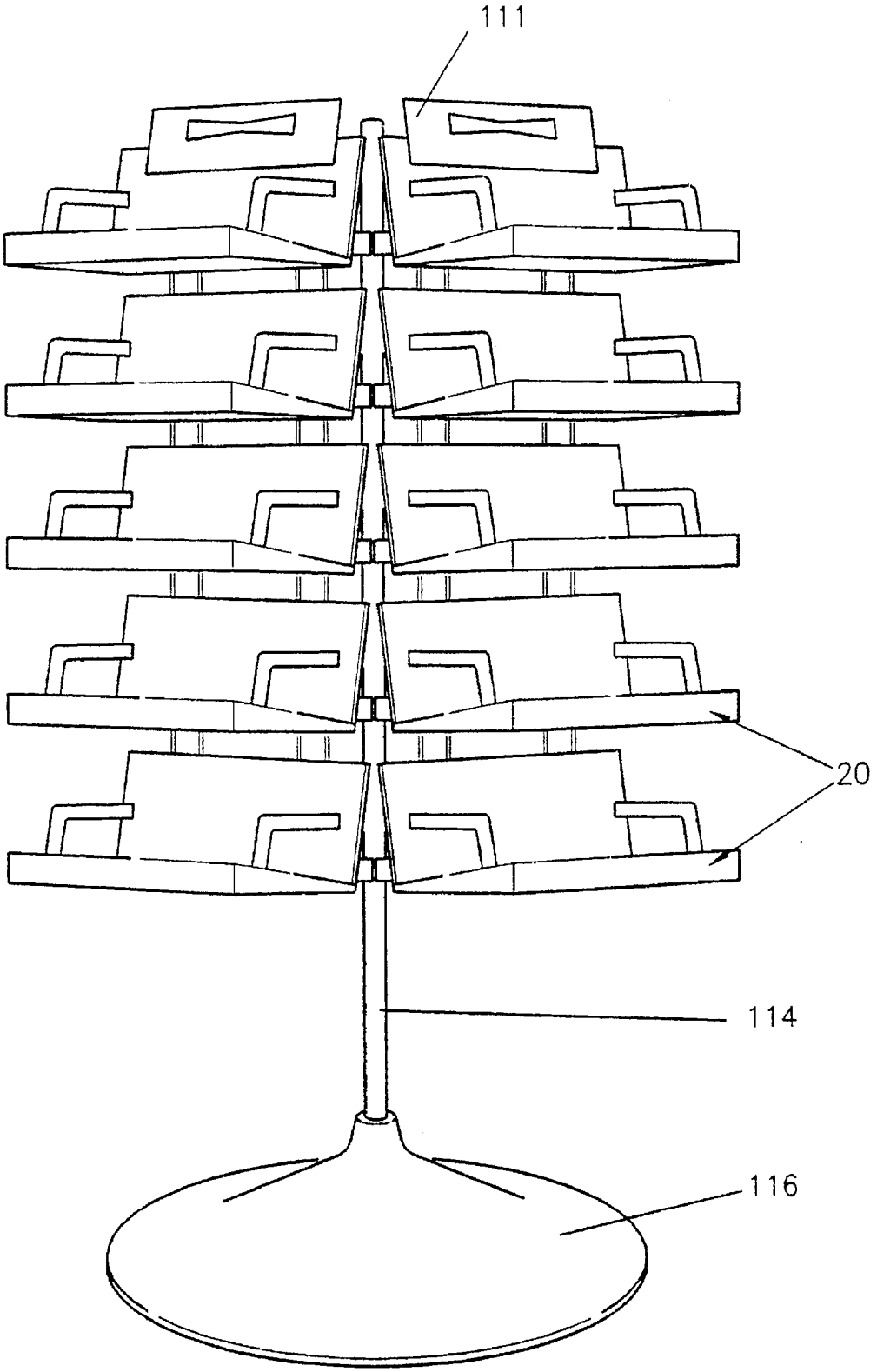
FIG. 16 is a perspective view showing the superposed display units mounted on a center pole of a freestanding display.
Figure 17:
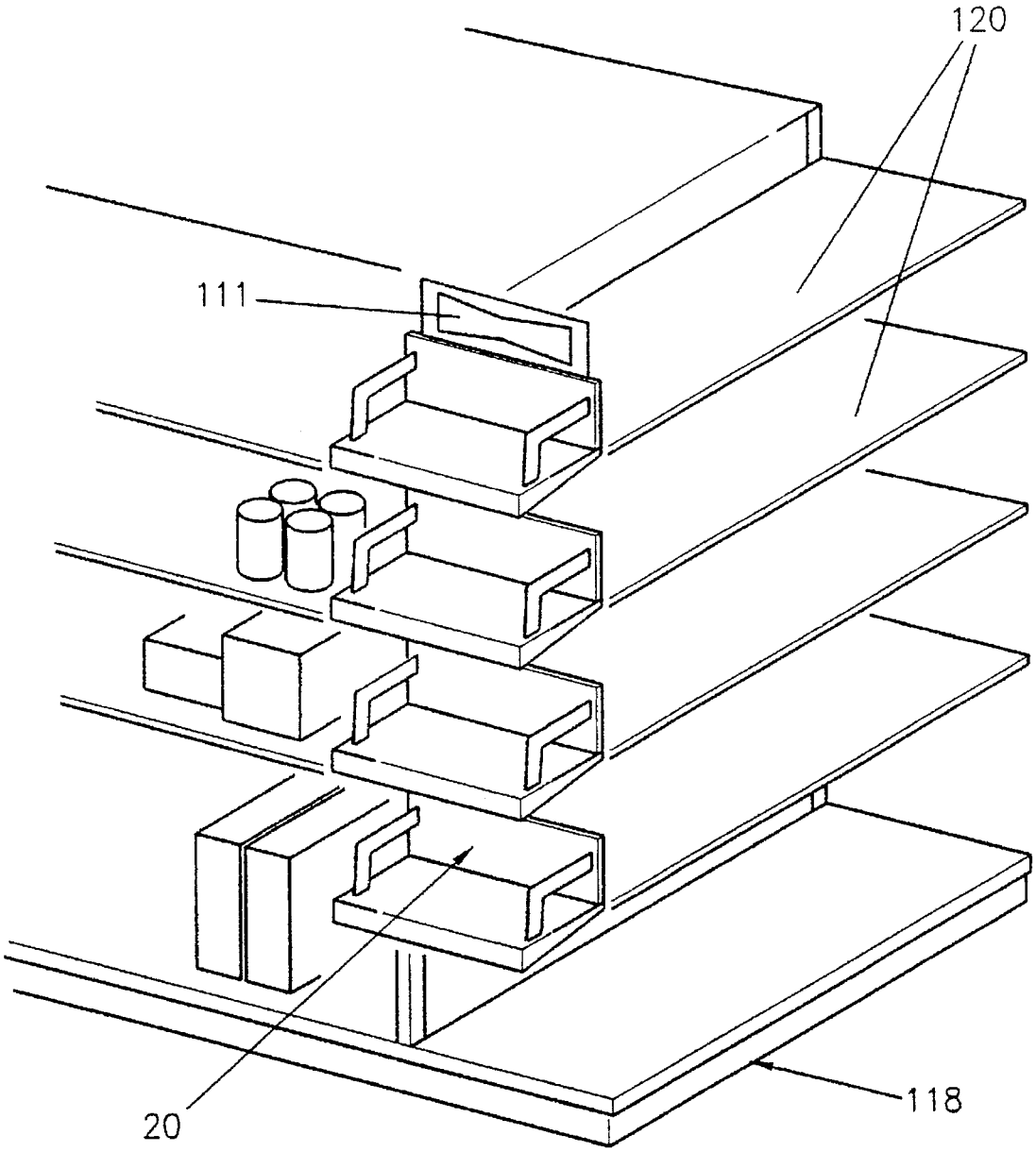
FIG. 17 is a perspective view showing the superposed units mounted at the end of a standard store shelving unit.

Apertures 110 in the back members 24 can be employed to affix a display sign 111, as shown in FIGS. 16 and 17, which can be positioned to project above the top of the back members 24 to provide customers with information concerning the products mounted on the display rack, as, for example, the product trademark.

Figure 15:
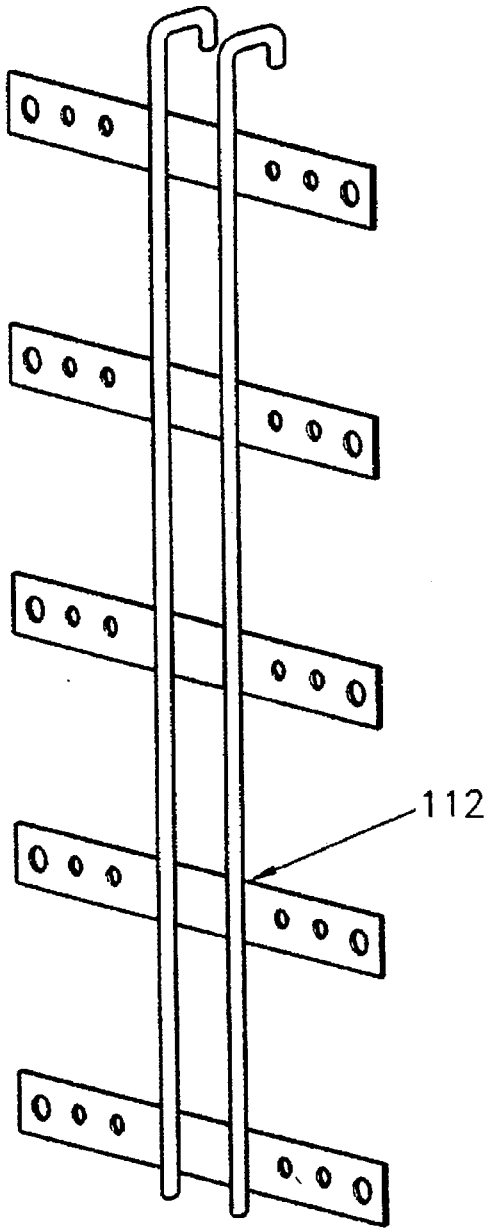
FIG. 15 is a perspective view showing a skeleton used in mounting the display units in a vertically superposed relation.

Finally, the support units 20 of the present invention are also adaptable for use by attachment to a skeleton which serves to support five individual support units stacked one above the other. In this manner, the stacked units can be hung from a free-standing center pole as shown in FIG. 16 or supported at the end if standard store shelving as shown in FIG. 17, or otherwise displayed. A suitable skeleton 112 to provide the attachment means is disclosed in FIG. 15. In FIG. 16, a center pole 114 projects upwardly from a free-standing base 116 to enable the support units attached to the skeleton 112 to be mounted in superposed stacks five high. In FIG. 17, a five high stack of support units attached to the skeleton 112 is mounted at the end of a store display having standard shelving 120. Using the skeleton to superpose the display units in a five high configuration, it is also possible to mount such units directly to a supporting wall.

After reading the foregoing detailed description, it should be apparent that the objects set forth at the outset of this specification have been successfully achieved by the present invention. Various changes and modifications apparent to those skilled in the art may be made without departing from the spirit and scope of the invention as defined in the appended claims.

What is claimed is:

1. A modular display unit, comprising:

a support unit consisting of a base member and a back member;

said base member and said back member being interconnected and disposed at substantially right angles to each other;

said base member having a rear edge at which said back member is interconnected and a forward edge spaced away from said rear edge;

said support unit further including a front member depending from said forward edge of said base member;

said front member including engagement means along the forward surface thereof;

said back member having a front surface directed toward said base member front edge and an opposed rear surface;

said back member engagement means being removably interengageable with said front member engagement means of another support unit whereby two support units can be coupled by interengaging said back member engagement means from one support unit with said front member engagement means of another support unit.

2. A modular display unit as defined in claim 1 wherein said front member and said back member are substantially parallel.

3. A modular display unit as defined in claim 2 wherein one of said interengageable engagement means comprises first projecting flanges forming an elongated channel and wherein the other of said interengageable engagement means comprises second projecting flanges which slidably fit within said channel.

4. A modular display unit as defined in claim 3 said front member depends from the front edge of said base member by a distance sufficient to cause said base member and interconnected back member to incline rearwardly by an acute angle when the bottom of said front member and the rear of said base member rest upon a flat surface.

5. A modular display unit as defined in claim 4 wherein said acute angle is between 10 and 15 degrees.

6. A modular display unit as defined in claim 4 further including:

leg engaging means on the underside of said base member, and a pair of leg members, each engageable with said leg engaging means to support said support unit in an elevated position.

7. A modular display unit as defined in claim 6 wherein each leg member has a bottom adapted to rest upon a supporting surface and a top adapted to engage with the leg engaging means.

8. A modular display unit as defined in claim 7 wherein said leg member top is disposed at said acute angle with respect to said leg member bottom.

9. A modular display unit as defined in claim 4 further including:

rail receiving openings along the sides of the base member and back member, and a pair of side rails adapted to fit into the rail receiving openings along the sides of the support unit to provide a means for preventing products positioned on the base member from being laterally dislodged.

10. A modular display unit as defined in claim 6 further including:

leg engaging means on the underside of said base member, and alternative leg members having spaced parallel upper and lower leg portions interconnected by an upright portion;

said lower leg portions of said alternative leg members being engageable with said leg engaging means of a first support unit and said upper leg portions of said alternative leg members being engageable with said leg engaging means of a second support unit to position said second support unit directly above said first support unit.

11. A modular display rack comprising:

a plurality of interconnected display units;

each of said display units including a base member and a back member;

said base member having a forward and a rear edge and said back member having an upper and lower edge;

said back member and base member of each display unit being interconnected with the back member lower edge positioned adjacent to said base member rear edge;

each of said display units further including a front member connected with said base member and positioned adjacent to said base member front edge;

said front member being substantially parallel to said back member and depending downwardly beneath said base member while said back member projects upwardly above said base member;

each of said display units further including an interengagement means to enable back said member of one display unit to releasably engage with a front member of another display unit;

said interengagement means including:

a first set of flange elements on the front surface of said front member, and a second set of flange members on the rear surface of said back member, one of said sets of flange members defining a channel and the other of said sets of flange members being slidably engageable with said channel;

said second set of flange members being disposed near the top of said back member whereby, when said interengagement means connect one display unit with another display unit, the back member of the lower display unit will not project above the base member of the higher engagement unit.

12. A modular display rack as defined in claim 11 further including leg members adapted to support the lowermost display unit upon a supporting surface;

said leg members including a bottom adapted to rest upon the supporting surface and a top adapted to rest against the underside of the base member of the lowermost display unit.

13. A modular display rack as defined in claim 12 wherein said base members of said display units include channel elements on the underside thereof and wherein the top of said legs is slidably engageable within said channel elements.

14. A modular display rack as defined in claim 11 further including rail receiving openings along the sides of each display unit back member and base member, and side rail members adapted to fit within said openings to prevent products positioned upon a base member from being laterally dislodged.

* * * * *